United States Patent [19]

Morris

[11] Patent Number: 4,789,839

[45] Date of Patent: Dec. 6, 1988

[54] METHOD AND APPARATUS FOR INJECTING CHARGED PARTICLES ACROSS A MAGNETIC FIELD

[76] Inventor: Donald E. Morris, 44 Marguerita Rd., Kensington, Calif. 94707

[21] Appl. No.: 877,915

[22] Filed: Jun. 24, 1986

[51] Int. Cl.[4] ..... H05H 13/00

[52] U.S. Cl. ..... 328/234; 313/62

[58] Field of Search ..... 313/62; 328/234; 250/294, 298

[56] References Cited

U.S. PATENT DOCUMENTS 3,896,392 7/1975 Hudson et al. ..... 328/234

OTHER PUBLICATIONS

A. J. Cox, et al., *Nucl. Instr. Methods* 18–19 (1962) 25.

J. L. Belmont, et al., *IEEE Trans. Nucl. Sci.,* NS-13, No. 4 (1966) 191.

A. U. Luccio, Lawrence Radiation Laboratory Report UCRL-18016 (1968).

V. A. Gladyshev, et al., Soviet Atomic Energy (Transl.) 18, No. 3 (1956) 268.

R. Beurtey, et al., *Nucl. Instr. Methods* (1965) 33:338.

*IEEE Trans. Nucl. Sci.,* NS-13, No. 4, (1966) 179.

*Nucl. Instr. Methods* (1967) 57:313.

C. Bieth, et al., *IEEE Trans. Nucl. Sci.* NS-13, No. 4 (1966) 182.

D. J. Clark, Lawrence Radiation Laboratory Report UCRL-18980 (1969).

Lawrence Berkeley Laboratory Report LBL-654 (1972).

*Primary Examiner*—Leo H. Boudreau

*Assistant Examiner*—Sandra L. O'Shea

*Attorney, Agent, or Firm*—Townsend and Townsend

[57] ABSTRACT

A new method is described for injecting charged particles across a magnetic field, in which an electrostatic reflector (bouncer) reverses the direction of the ions after they travel around a half orbit in the magnetic field. This method can be used for radial injection of charged particles into a cyclotron, or into a plasma confined by a magnetic field.

5 Claims, 2 Drawing Sheets

METHOD AND APPARATUS FOR INJECTING CHARGED PARTICLES ACROSS A MAGNETIC FIELD

BACKGROUND OF THE INVENTION

1. Field of the Invention

I have invented a new method and apparatus using an electrostatic reflector (bouncer) for injecting charged particles across a magnetic field. This method can be used to inject charged particles into a cyclotron, or possibly into a plasma confined by a magnetic field. Injection of ions into a cyclotron from an external source is advantageous since it permits uses of sources too large to fit in the center of the cyclotron, and does not require the source to operate in the strong magnetic field of the cyclotron. It also permits easy changes of the source, and of the ions to be accelerated.

2. Description of the Related Art Including Information Disclosed Under 37 C.F.R. 1.97

The usual method of injection from an external source involves an axial hole in one pole of the cyclotron magnet. A. J. Cox, et al., *Nucl. Instr. Methods* 18-19 (1962) 25. The beam of ions passes through this hole to the midplane of the cyclotron. The beam is then deflected through an angle of 90° by a reflector inclined at 45° to the axis or by a helical electrostatic channel, and then begins the usual circular motion in the midplane of the cyclotron. J. L. Belmont, et al., *IEEE Trans. Nucl. Sci.*, NS-13, No. 4 (1966) 191. The axial injection method is complicated, especially when used in a small cyclotron. Several lenses are required to transport the beam through the axial hole, and the magnetic field in the central region is non-uniform because of the axial hole. A.U. Luccio, Lawrence Radiation Laboratory Report UCRL-18016 (1968). These problems are avoided by radial injection methods.

A radial injection method which is suitable for sector focussing cyclotrons was developed at the Lebedev Institute V. A. Gladyshev, et al., Soviet Atomic Energy (Transl.) 18, No. 3 (1965) 268. The orbit center of a particle in a magnetic field follows a path of constant field, so the hill-valley magnetic field difference in a AVF cyclotron can be used to send the beam on a trochoidal path to the center region. At the center, an electrostatic channel is used to inflect the beam into a centered orbit. When the injection energy is very small, the loops in the injection beam trajectory overlap, reducing the clearance in the electrostatic channel. In another method, developed at Saclay, the ion beam was directed radially inward in the midplane across the magnetic field of the cyclotron, and the radius of curvature of the beam was increased by an electrostatic field provided by four bars, two above and two below the midplane. R. Beurtey, et al., *Nucl. Instr. Methods* (1965) 33:338; *IEEE Trans. Nucl. Sci.*, NS-13, No. 4, (1966) 179; and *Nucl. Instr. Methods* (1967) 57:313. The bars were oriented nearly radially, with one bar of each pair positive and the other negative. The electric field of the four bars provided an effective "channel" through which the beam could be injected. When the beam reached the inner end of the bars the usual circular motion in the magnetic field began. A disadvantage of this method is the complicated and accurate shaping of the bars which is required so that the electric field will match the magnetic field profile of the cyclotron. A third method of radial injection, suitable for injection of heavy ions at relatively high energy into large cyclotrons was developed at Orsay. C. Bieth, et al., *IEEE Trans. Nucl. Sci.* NS-13, No. 4, (1966) 182. The ions, in low ionization states were injected in the midplane, and reached the center in about a half turn. The ions were stripped in a foil positioned to give centered orbits at a higher charge state. These and other external beam injection systems have been reviewed by Clark. D. J. Clark, Lawrence Radiation Laboratory Report UCRL-18980 (1969), and Lawrence Berkeley Laboratory Report LBL-654 (1972).

SUMMARY OF THE INVENTION

The present invention pertains to a heretofore unknown method and apparatus employing an electrostatic reflector (bouncer) for the purpose of injecting charged particles across the magnetic field of a cyclotron. In the preferred embodiment of the invention, a beam of particles enter the magnetic field through a inflector/velocity selector, and the incoming beam is focused at an initial focus. The charged particles are allowed to travel through a semicircle in the magnetic field and come to a radial focus at a bouncer. They are then bounced or reflected by a localized uniform electric field to reverse their direction of motion. They then travel through another semicircle and focus at a secondary focus. During the passage from the bouncer to the secondary focus, the particles are accelerated while crossing the gap between a Dee and an upper dummy Dee as in any cyclotron. The acceleration is repeated during the return from the secondary focus to the bouncer in the second half of the orbit. Since the particles have gained energy during the orbit, they will miss the bouncer on their return around the enlarged orbit. The particles will continue to spiral out and gain energy at each Dee crossing in the usual way until they reach a deflector/velocity selector and leave the magnetic field. In the preferred embodiment of the invention, the radial distance to the deflector is made smaller than the radial distance to the inflector, so that the particles can be removed before they strike the inflector. This limits the final particle orbit radius to three times the initial radius, and the final energy to nine times the injection energy.

Injection of ions into a cyclotron from an external source is advantageous since it permits use of sources too large to fit in the center of the cyclotron, and does not require the source to operate in the strong magnetic field of the cyclotron. It also permits easy changes of the source, and of the ions to be accelerated.

There are several reasons why this method of injection would be attractive for injecting ions into a cyclotron, especially one of low energy:

(1) The ions can be injected in the midplane of the cyclotron, so an axial hole in the pole piece, which could interfere with the uniformity of the magnetic field, is not required. This also eliminates the need for a vacuum seal to the pole piece, so a removable bakeable vacuum Dee chamber can be used.

(2) The bouncer can be made small since the magnetic field of the cyclotron focuses the beam of particles on the bouncer. This also ensures that the centers of the orbits of all of the ions lie on the line of the Dee-dummy Dee gap, so the particles will stay in phase as they are accelerated.

(3) The bouncer is a small, simple device and is easily located in the required position. It can be made of non-magnetic materials, so that there will be no strong magnetic forces to contend with, and the uniformity of the magnetic field will not be affected.

(4) With this injection method the central region of the cyclotron chamber is not used. The Dee chamber can be independent of the magnet poles, and the vacuum walls of the Dee chamber can be supported near the axis by a strut (No. 18 in FIG. 2). This is helpful in the design of a removable and bakeable, Dee Chamber which is especially desirable in a cyclotron used for mass spectroscopy, trace isotope measurement, or isotope dating. Space is available in the central region for an NMR Gaussmeter for precision determinations of charge/mass ratio of the particle to be accelerated.

DETAILED DESCRIPTION OF THE INVENTION

Figure 1:
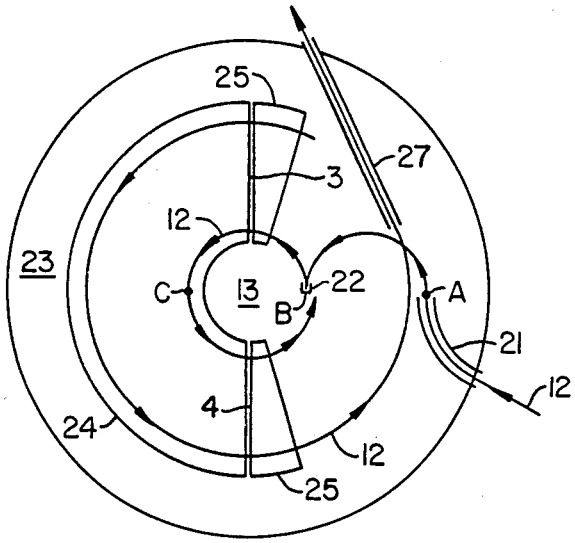
FIG. 1 is a horizontal cross-sectional schematic view of the preferred embodiment of the invention taken along the plane of the beam of charged particles.
Figure 2:
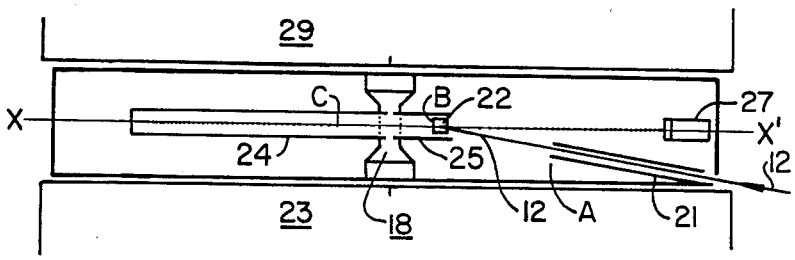
FIG. 2 is a vertical cross-sectional view of an alternative embodiment of the invention taken along a cyclotron diameter.

Referring to FIGS. 1 and 2, a magnetic field emanates perpendicularly from lower magnetic pole face 23, and passes into the upper magnetic pole face 29. A beam of charged particles 12 enters the magnetic field from the right through an inflector/velocity selector 21. The incoming beam is focused at initial focus A. The beam of charged particles 12 is allowed to travel through a semicircle between respective points A-B in the magnetic field and come to a radial focus at bouncer 22. The beam is then bounced or reflected by a uniform electric field localized at point B in order to reverse its direction of motion with respect to its incident direction of travel. The beam 12 then travels through another semicircle between point B and C and focuses at secondary focus point C. During the passage from point B to point C, the particles in beam 12 are accelerated while crossing gap 3 between dummy Dee 25 and Dee 24, as is the case in any cyclotron. The acceleration is repeated in the other half of the orbit, illustrated in FIG. 1 as semicircle between points B and C, during the return from point C to point B, i.e., from Dee 24 to dummy Dee 25 across the gap at 4. Since the particles have gained energy during their orbit, the orbital radius will increase such that the charged particles will miss impacting with the bouncer 22 upon completing their first 360° orbit from B to C and back past B.

The beam 12, as in any other cyclotron, will spiral out and gain energy each time while crossing gaps 3 and 4. The energy and, consequently, the orbital radius will increase until the beam 12 reaches deflector/velocity selector 27 and exit the magnetic field. In the arrangement shown in FIG. 1, the radial distance to the deflector/velocity selector 27 is made smaller than the radial distance to the injecting inflector/velocity selector, such that the beam 12 can be removed before it is incident upon the inflector/velocity selector 21. Assuming the injector 21 is in the same plane as the rest of the cyclotron, this limits final particle beam 12 orbit radius to three times the initial radius, and the final energy to nine times the injection energy.

This limitation of the ratio between final and injection energy can be overcome if the injector is not in the plane of the orbits of the beam of particles.

Figure 6:
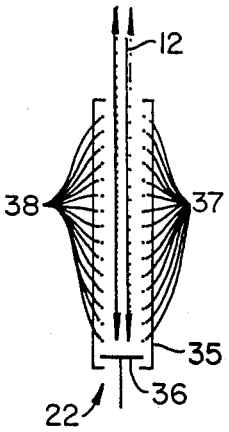
FIG. 6 is a cross-sectional schematic view of another alternative embodiment of the bouncer.

As shown in FIG. 2, the injector/velocity selector 1 is preferably placed below the plane of the beam, which is shown in cross-section as line XX'. The bouncer 22 is inclined, so that a small component of its internal electric field is directed along the cyclotron axis YY' to reduce the axial velocity of the particles to zero after bouncing. As shown in FIG. 6, the required axial electric field can of course be provided by a difference between the potentials of auxiliary reflecting electrodes 37 and 38 in the bouncer 22, where 37 is closer to pole face 23 and 38 is closer to pole face 29. Thus, the beam of particles will not strike the injector during acceleration to large radius orbits with energy greater than 9 times the injection energy.

Figure 3A:
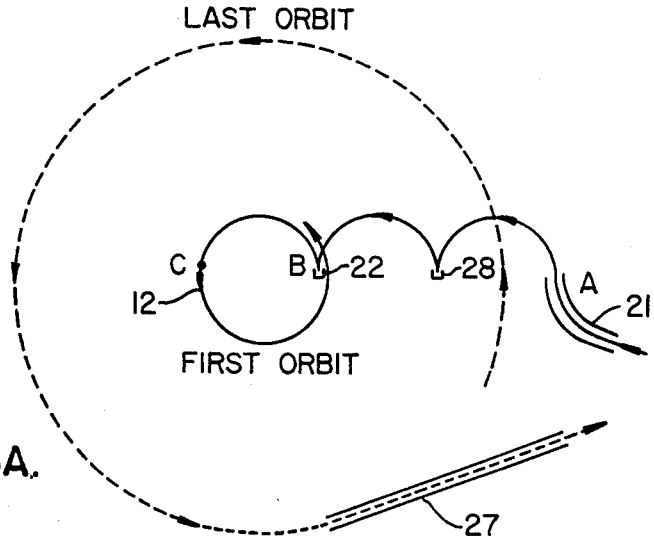
FIG. 3A is a schematic view of an alternative embodiment of the invention illustrating the use of multiple bouncers in the cyclotron particle path.
Figure 3B:
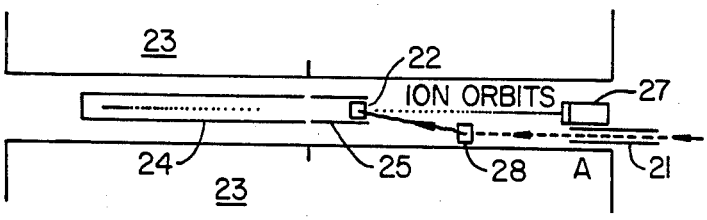
FIG. 3B is a vertical cross-sectional view of a cyclotron employing an alternative embodiment of the invention using multiple bouncers in the cyclotron particle path.

In another arrangement, shown in FIGS. 3A and 3B, a second bouncer 28 can be placed farther from the center and below the plane of the beam 12. From initial focus A, which is placed either in or near the beam plane, the beam of charged particles 12 is directed radially in to second bouncer 28. It is important to note that bouncer 28 is not in the beam plane so as to avoid bouncer 28 being struck by the outgoing accelerated particles in the beam path. Bouncer 28 is adapted to reverse the direction of the beam 12 such that beam 12 is directed to bouncer 22 in the beam plane. The beam of charged particles 12 is radially focused at initial focus point A, and will refocus at bouncer 28, bouncer 22, point C, etc.

The arrangement described above will allow acceleration of the beam of particles to energies greater than 9 times the injection energy.

Figure 4:
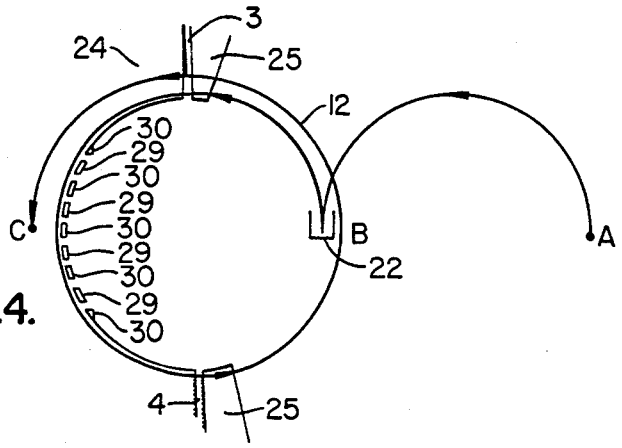
FIG. 4 is a partial cross-sectional schematic view of an alternative embodiment of the invention illustrating the use of booster electrodes within the cyclotron.

Another device, illustrated in FIG. 4, may be added to give additional energy to the charged particles while they go around the first orbit to increase the clearance from the bouncer 22. A set of "booster" electrodes 29 and 30 are placed around the inside of the first orbit near point C and connected to an RF voltage source which is at a harmonic of the cyclotron frequency of the beam of charged particles 12. If the Dee 24 is operated at a harmonic of the cyclotron frequency alternate electrodes 30 and 29 can be connected to the Dee 24 and to the dummy Dee 25 (ground) respectively. The electrodes 29 and 30 are spaced at half the distance the charged particles would travel in one period of the RF. As the charged particles pass near the electrodes 29 and 30 during their first orbit they will be accelerated several times and gain much more energy than the voltage of Dee 24. After the first orbit the charged particles will not come near enough to the electrodes 29 and 30 to be further accelerated by them, and will gain energy only from the Dee 24 gaps 3 and 4 crossings in the usual way.

It may be useful to adjust the angular position of the electrodes 29 and 30 to give maximum energy boosts to charged particles which cross gaps 3 and 4 after the RF voltage has passed its peak and is falling, since particles constituting the beam 12 will be axially electrostatically focused during acceleration when their phase is in this range.

Figure 5:
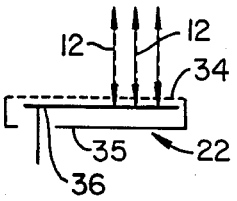
FIG. 5 is a cross-sectional schematic view of an alternative embodiment of the bouncer.
Figure 7:
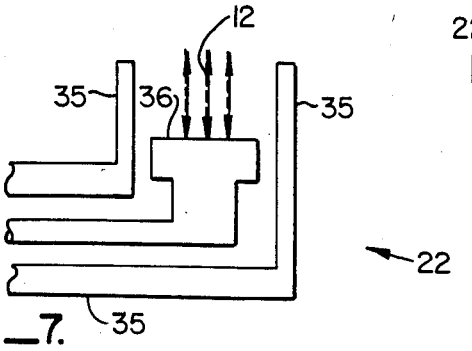
FIG. 7 is a cross-sectional schematic view of an alternative embodiment of the bouncer adapted for reflecting an intense beam of charged particles.

There are many possible designs for the bouncer 22. Some examples are shown in FIGS. 5, 6 and 7. A repeller electrode 36, shown in FIGS. 5, 6, and 7, is operated at a potential greater than the energy of the beam to be injected. In FIG. 5, a grid 34 is connected to a grounded shielded box 35 to provide a uniform retarding field and prevent leakage of the field out to the region where the beam 12 passes the bouncer 22 after the first orbit. In FIG. 6, different potentials are applied to guard wires 37 proportional to their distances from the top opening 38 to give a uniform electric field inside the bouncer 22. The width of the opening at 39 is made small compared to the depth of the shielded box 35 such that the fringing field outside the shielded box 35 will be small. FIG. 7 shows an open bouncer 22 which could reflect an intense beam of charged particles, and could be adapted to contain water cooling to resist destruction of the repeller electrode 36 from bombardment by oppositely charged particles attracted to the repeller electrode 36.

The reader will understand that once the particle injection apparatus and method is practiced to inject a particle, it is only required that the injected particle have its momentum changed. This momentum change must be such that the particle will not return to the reflector apparatus, which return would result in obstruction of the beam. The required change of velocity can be achieved by acceleration, deceleration or change of particle direction—for example by scattering. Since all of these particle movements are changes in particle momentum, momentum is the term used herein.

Regarding the change of velocity by acceleration, deceleration or change of particle direction, this may be accomplished by a number of expedients. For example, an alternative electric field can be placed within the magnetic field. This alternating electric field can alternate at the cyclotron resonant frequency of the particles or at a harmonic of the cyclotron resonant frequency.

Moreover, accelerating, decelerating or change of particle direction can occur by placement of a static electric field between the source region and the region within the magnetic field. Likewise, a static electric field can be placed between different parts of the magnetic field egion to effect the same result.

Furthermore, acceleration, deceleration or change of particle direction can occur by the scattering of the particles in resonant orbit around the cyclotron by other particles present within the magnetic field region.

The later two expedients of the static electric field and the presence of other particles are especially relevant where a plasma is confined within the magnetic field region.

What is claimed is:

1. The improvement in a particle injector for a cyclotron wherein the cyclotron has a magnetic field extending normal to circular paths about a central point for accelerating particles within said cyclotron and includes along said paths first and second opposed means for receiving charge for accelerating charged particles in circles about said central point in said cyclotron, the improvement comprising:

a particle injector having an output substantially normal to said magnetic field along an injection path, said injection path being circular within said magnetic field, said injection path being nonconcentric about said central point and disposed within said magnetic field of said cyclotron, said injection path being focused to a point of reflection within said cyclotron; and means of reflecting particles within said cyclotron disposed at said point of reflection within said magnetic field of said cyclotron for causing said reflected particles from said injection path to pass along a reflected path concentric to said central point for acceleration along the circular paths about said central point of said cyclotron.

2. The invention of claim 1 and wherein the radial distance between the point of reflection and said central point of said particles about said cyclotron is one-half the distance from the injector to said point of reflection.

3. A cyclotron comprising in combination:

means for generating a magnetic field normal to circular paths about a central point in said accelerator;

means for generating opposed electric fields across a portion of said circular paths for accelerating particles in a circular pattern about said central point in said magnetic field;

a particle injector for injecting particles substantially normal to said magnetic field, said injector being disposed to pass particles along an initial path made arcuate by said magnetic field but not concentric to said central point said particles focused to a point of reflection; and means for reflection of said particles disposed at said point of reflection for causing said particles passing along said path of injection to rebound into a second, circular path about said central point for acceleration within said cyclotron.

4. The invention of claim 3 and wherein said particle injector is oblique from said point of injection to said point of reflection about the center of said cyclotron.

5. A method for injecting a beam of charged particles into a magnetic field, comprising:

injecting the beam of particles into the magnetic field;

focusing the beam at an initial point of focus within the magnetic field, whereupon the beam travels through a semicircular arc within the magnetic field;

radially focusing the beam at a secondary focus point;

reflecting the beam at the secondary focus point by applying a localized electric field such that the direction of the beam is reversed; and changing the momentum of the particles so that they will not return to the said secondary focus point of charged particles in the beam.

* * * * *